US005997414A

United States Patent [19]

Dalton

[11] Patent Number: 5,997,414

[45] Date of Patent: Dec. 7, 1999

[54] GOLF CLUB HEAD

[75] Inventor: John Arthur Dalton, Hong Kong, The Hong Kong Special Administrative Region of the People's Republic of China

[73] Assignee: Golf Insert Corporation, Rutland, United Kingdom

[21] Appl. No.: 08/527,937

[22] Filed: Sep. 14, 1995

Related U.S. Application Data

[63] Continuation of application No. 08/244,303, May 25, 1994, abandoned.

[30] Foreign Application Priority Data

Nov. 26, 1991 [AU] Australia ..... PK9666

[51] Int. Cl.[6] ..... A63B 53/04

[52] U.S. Cl. ..... 473/342; 473/350

[58] Field of Search ..... 273/167 R, 167 A, 273/167 F, 167 G, 169, 170, 171, 172, 173, 77 A, 77 R, DIG. 23, 174, 175, 78, 167 H, 167 J; 473/324–350

[56] References Cited

U.S. PATENT DOCUMENTS

| | | | |
|---|---|---|---|
| 2,429,351 | 10/1947 | Fetterolf | 273/173 |
| 3,218,072 | 11/1965 | Burr | 273/173 |
| 4,754,975 | 7/1988 | Aizawa . | |
| 4,793,616 | 12/1988 | Fernandez | 273/167 H |
| 4,798,383 | 1/1989 | Nagasaki et al. . | |
| 5,004,242 | 4/1991 | Iwanaga | 273/DIG. 23 |
| 5,176,384 | 1/1993 | Sata | 273/167 R |
| 5,198,062 | 3/1993 | Chen | 273/167 J |
| 5,346,213 | 9/1994 | Yamada | 273/173 |
| 5,398,929 | 3/1995 | Kitaichi | 273/173 |
| 5,411,264 | 5/1995 | Oky | 273/167 F |

FOREIGN PATENT DOCUMENTS

| | | |
|---|---|---|
| 59-82062 | 6/1984 | Japan . |
| 5-76625 | 3/1993 | Japan . |

*Primary Examiner*—Sebastiano Passaniti

[57] ABSTRACT

In accordance with one aspect of the invention, a cavity back iron type club head is provided with an insert at the striking face of the head with the insert being made of a material different than the material that makes up the remainder of the head body. The head body is formed of metallic material and is provided with a cavity at a rear portion of the head. The head body is perimeter weighted substantially completely around the perimeter at both the rear and a front of the head.

23 Claims, 3 Drawing Sheets

GOLF CLUB HEAD

This application is a continuation of application Ser. No. 08/244,303, filed May 25, 1994, now abandoned.

BACKGROUND OF THE INVENTION

1. Field of the Invention

This invention relates to the head of a golf club used for striking the golf ball between the teeing ground and the putting green, generally referred to as a "golf club".

The principal skill in accurate striking of the golf ball is to correctly contact the ball on that point on the striking face of the club, generally referred to as the "sweet spot".

2. Description of the Prior Art

A presently known golf club head is of the common blade shape having an elongated striking face and a thickness of only about half an inch consistent throughout its length. The thickness of said striking face may vary from the top to the bottom or sole of the club head.

Such a golf club head has the mass, or general overall head weight, evenly distributed over the elongated length of the portion located directly behind the striking face.

Alternatively, there have been developments in iron golf head technology which have provided peripheral weighting of the head mass by constructing the head in such a way as locating the major part of the head material, usually stainless steel, around the perimeter of the head shape. One such design is shown in U.S. Pat. No. D276644.

It has generally been tested and agreed that it is desirable for the club head to strike the ball at the "sweet spot", which is accepted by technologists in the industry as having a larger area if the peripheral weighting head design is used. The design of iron head shown in U.S. Pat. No. D276644 is considered to be the most improved design yet devised to provide an iron golf head with an enlarged "sweet spot".

It will be appreciated that considerable skill is required to accurately make contact with the golf ball at the "sweet spot", or centre of the mass of the club head at the forward portion, generally referred to as the "striking face", since the mass, or general overall headweight is spread throughout the length, or back portion of the striking face.

The golf club head with the perimeter weighted cavity back head shape such as that shown in U.S. Pat. No. D276644 has a cavity located behind the striking face at that point where the club head is required to make contact with the golf ball. In this case, the actual mass or head weight is generally located around the rear edge or perimeter of the golf head forming what is generally referred to as a "cavity back" golf club head.

It will be appreciated that the cavity back design of golf club head provides a larger sweet spot than would normally be provided in the case of the conventional blade shaped golf club head. However, it will be realised that because of the cavity back design, the thickness of the golf head in the area directly behind the contact point on the striking face where contact is made with the golf ball will be thinner than the striking point of the alternative blade shaped head.

It is an object of the invention to provide a golf club with a head so designed as to assist the player, generally referred to as the "golfer", to strike the ball at a point on the striking face which has a large sweet spot and also provides a better chance to "work" the golf ball.

SUMMARY OF THE INVENTION

In accordance with one aspect of the invention, a cavity back iron type golf club is provided having a head with a striking face, an insert being provided at the striking face of the head, the part of the head not including the insert comprising a rest of the head, the insert and thus at least part of the striking face of the head being made of a material different to the majority of the rest of the head, the majority of said rest of the head being metallic, wherein the insert is substantially surrounded in the striking face's plane by said rest of the head, wherein the head has a rear with a cavity, the cavity at the rear having an area approximately the same as that area of the rear excluding the cavity, and wherein the head is perimeter weighted substantially completely around its' perimeter at both its rear and front.

In accordance with another aspect of the invention, an iron type golf club is provided having a head with a striking face, an insert being provided at the striking face of the head, the part of the head not including the insert comprising a rest of the head, the insert and thus at least part of the striking face of the head being made of a material different to the majority of the rest of the head, the majority of said rest of the head being metallic, wherein the head has a rear with a cavity, the cavity being of the cavity back type, and wherein the head is perimeter weighted.

In accordance with a further aspect of invention, a cavity back iron type golf club is provided having a head with a striking face, an insert being provided at the striking face of the head, the part of the head not including the insert comprising a rest of the head, the insert and thus at least part of the striking face of the head being made of a material different to the majority of the rest of the head, the majority of said rest of the head being metallic, wherein the insert is substantially surrounded in the striking face's plane by said rest of the head, and wherein the head has a rear with a cavity, and wherein the head is perimeter weighted.

In accordance with another aspect of the invention, a cavity back iron type golf club is provided having a head with a striking face, an insert being provided at the striking face of the head, the part of the head not including the insert comprising a rest of the head, the insert and thus at least part of the striking face of the head being made of a material different to the majority of the rest of the head, the majority of said rest of the head being metallic, wherein the head has a rear with a cavity, the cavity at the rear having an area approximately the same as that area of the rear excluding the cavity, and wherein the head is perimeter weighted.

In accordance with yet another aspect of the invention, a cavity back iron type golf club is provided having a head with a striking face, an insert being provided at the striking face of the head, the part of the head not including the insert comprising a rest of the head, the insert and thus at least part of the striking face of the head being made of a material different to the majority of the rest of the head, the majority of said rest of the head being metallic, wherein the head has a rear with a cavity, and wherein the head is perimeter weighted substantially completely around its' perimeter at both its rear and front.

Such an arrangement provides a large sweet spot due to the cavity back design.

The mass of the head is located around the perimeter of the striking point or sweet spot on the face where it makes contact with the ball. The material in the striking face or sweet spot is preferably non-metal and consists of a synthetic or plastic material commonly referred to as a thermoplastic but having included in its make up a system of fibers which provide added strength and hardness according to the kind of epoxy or base resin used in the composite of the non-metal material.

Many different kinds of non-metal materials may be used without deterring from the ambit of the invention.

Also, it will be apparent that the material located in the striking face or sweet spot area may also be of metallic substance or an alloy of any metal material. The invention incorporates additional "different" materials in the centre part or sweet spot area of the striking face in a manner which is technically simple and comparatively inexpensive.

It should be realised that the metallic mass of the head may be made from any known metal commonly used in golf club heads, such as stainless steel, aluminium, berrylium copper, brass compounds, bronze, zinc and other kinds of metallic compounds.

It is well known that the most common form of composite fiber iron head construction is made by what is generally referred to in the golf industry as the compression moulding process. However, the non-metallic portion of the striking face or sweet spot of the present invention is suitably constructed by injection moulding or what is commonly referred to in the golf industry as the injection process.

One method of accomplishing this new construction is by "casting" a frame or skeleton or an iron head by lost wax or other suitable method and then locate "the casting" in a specially designed "injection mould" and having the thermoplastic "injected" into the striking face area in the conventional injection moulding process manner.

Preferably a thin piece of metallic material is situated throughout the length of the striking face in such a way as to provide "a backing" to the injected non-metallic material. The backing has specially designed access holes so as to provide a means for the non-metallic injected material to pass through into the "back cavity" area of the iron head.

The invention provides an iron head golf club incorporating a material substantially different in make up to the head material and which provides improved performance features over conventional "one material" or solid metal compound iron heads. The invention preferably uses the compression moulding method to locate a non-metal or composite fiber material in the central or striking face area of the iron head, and still provide the peripheral weighted head design.

The invention suitably provides a cavity back type of peripheral weighted head design modified by having a securely located non-metallic material forming the striking face area of the head in such a way as to be an improved method of constructing a golf iron having two or more separate and distinct materials which are considered to be highly suitable for the purpose and also having technically advantageous features when considering other forms of conventional golf head constructions.

It is to be understood that the substance of the materials used does not detract from the ambit of the invention and a wide range of non-conventional materials, either metallic or non-metallic, may be used by the injection, compression or die-cast process although the most suitable process so far used which is simple to effect and economically cheaper to produce is by the injection method.

Figure 1:
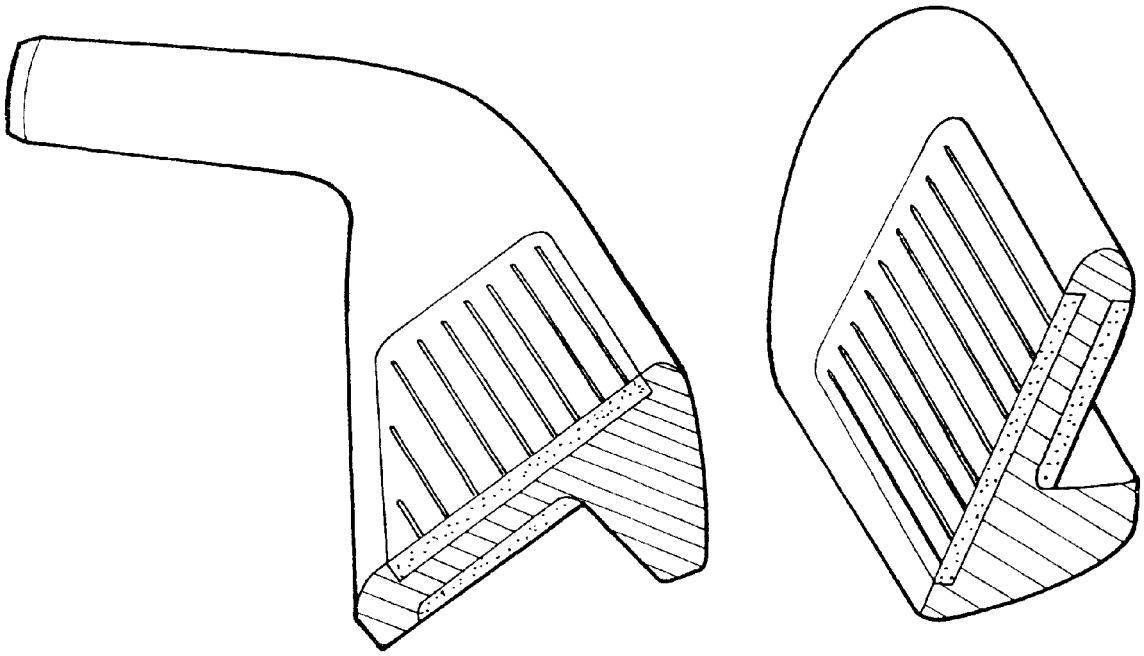
FIG. 1 shows a golf club head in accordance with the invention cut in half to show its construction.

A cross sectional appearance of an iron in accordance with the invention showing the injection process method utilised is shown in FIG. 1, however, other designs of cross section may be used without detracting from the ambit of the invention.

Figure 2:
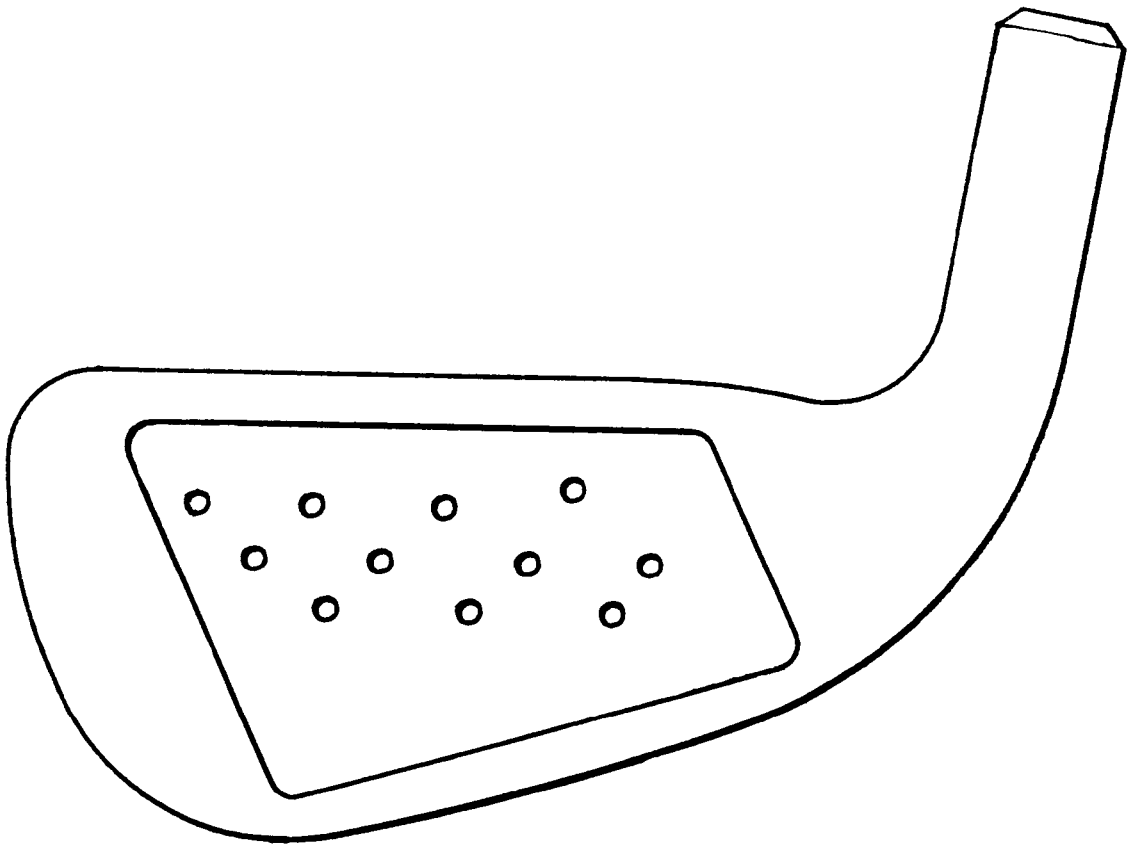
FIG. 2 shows the front of the golf club head of FIG. 1 with the front insert removed.
Figure 3:
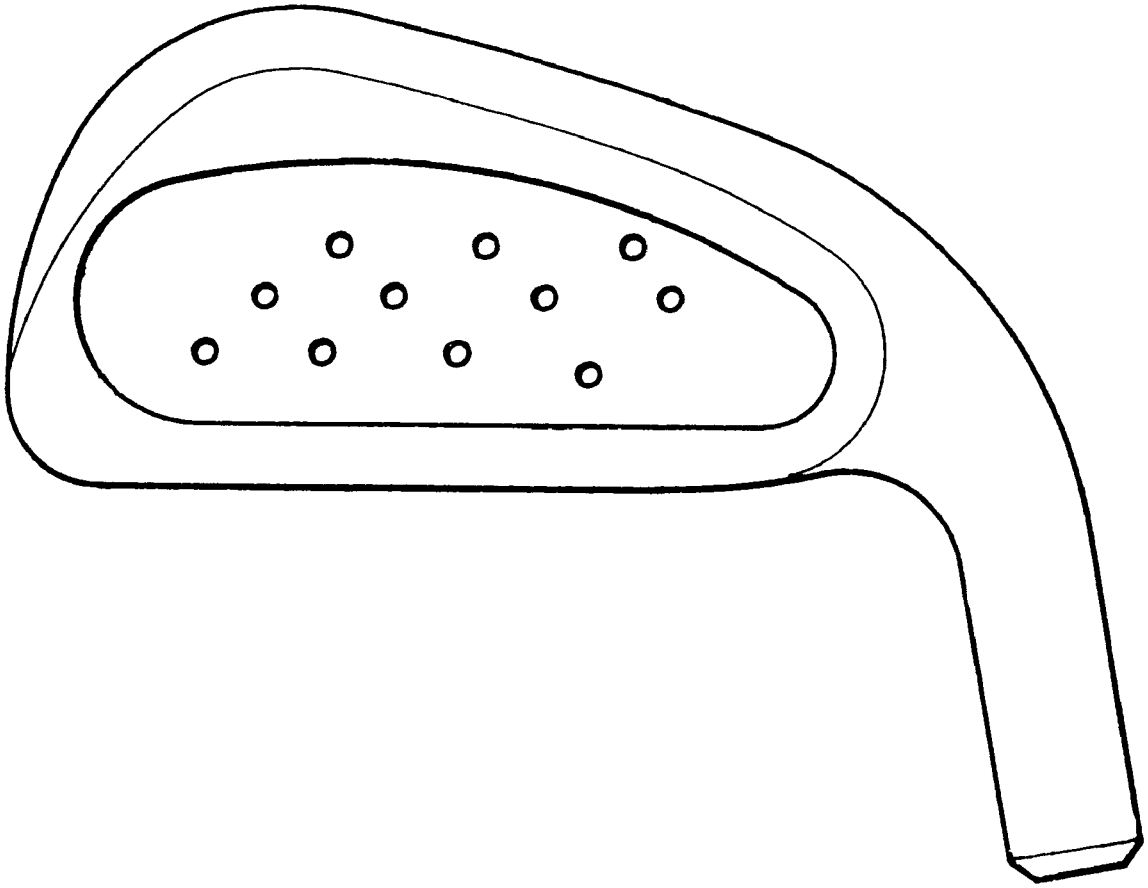
FIG. 3 shows the rear of the golf club head of FIG. 1 with the rear insert removed.

A front and rear view of the iron of FIG. 1 showing the injection process method of construction of an iron head is also shown in FIG. 2 and FIG. 3 respectively.

The iron golf club head shown in FIGS. 1 to 3 comprises a main body made of metal, an insert in the striking face made of a material different to the rest of the head, and a further insert in the back of the head, the back of the head being provided with a cavity.

Suitably the insert in the striking face and the insert in the back cavity are made of the same material (such as a metal coated graphite) such that they can be injection moulded together to securely fix the insert in the striking face.

Preferably the major part of the metallic main body of the head is located around the perimeter of the head shape, and the centre portion of the rear of the head has a substantially concave shape. In particular, the width of the centre portion of the head is less than either the width of the top or bottom parts of the head (as seen in cross section) with or without the front and/or rear inserts. The mass of the perimeter is also concentrated at the bottom of the head relative to the top of the head.

As mentioned above, the insert in the striking face and the insert in the back cavity are made of a resin compounded with a metal coated graphite fibre product such as nickle coated graphite, gold coated graphite, bronze coated graphite, platinum coated graphite and copper coated graphite. Such are light yet strong, can be moulded easily into shape, are available in many different colours, and is unaffected by moisture.

I claim:

1. A cavity back iron type golf club having a head with a striking face, an insert being provided at the striking face of the head, the part of the head not including the insert comprising a rest of the head, the insert and thus at least part of the striking face of the head being made of a material different to the majority of the rest of the head, the majority of said rest of the head being metallic, wherein the insert is substantially surrounded in the striking face's plane by said rest of the head, wherein the head has a rear with a cavity, the cavity at the rear having an area approximately the same as that area of the rear excluding the cavity, and wherein the head is perimeter weighted substantially completely around its' perimeter at both its rear and front.

2. An iron type golf club having a head with a striking face, an insert being proved at the striking face of the head, the part of the head not including the insert comprising a rest of the head, the insert and thus at least part of the striking face of the head being made of a material different to the majority of the rest of the head, the majority of said rest of the head being metallic, wherein the head has a rear with a cavity, the cavity being of the cavity back type, and wherein the head is perimeter weighted.

3. A cavity back iron type golf club having a head with a striking face, an insert being provided at the striking face of the head, the part of the head not including the insert comprising a rest of the head, the insert and thus at least part of the striking face of the head being made of a material different to the majority of the rest of the head, the majority of said rest of the head being metallic, wherein the insert is substantially surrounded in the striking face's plane by said rest of the head, and wherein the head has a rear with a cavity, and wherein the head is perimeter weighted.

4. A cavity back iron type golf club having a head with a striking face, an insert being provided at the striking face of the head, the part of the head not including the insert comprising a rest of the head, the insert and thus at least part of the striking face of the head being made of a material different to the majority of the rest of the head, the majority of said rest of the head being metallic, wherein the head has a rear with a cavity, the cavity at the rear having an area approximately the same as that area of the rear excluding the cavity, and wherein the head is perimeter weighted.

5. A cavity back iron type golf club having a head with a striking face, an insert being provided at the striking face of the head, the part of the head not including the insert comprising a rest of the head, the insert and thus at least part of the striking face of the head being made of a material different to the majority of the rest of the head, the majority of said rest of the head being metallic, wherein the head has a rear with a cavity, and wherein the head is perimeter weighted substantially completely around its' perimeter at both its rear and front.

6. An iron type golf club as claimed in either claim 2, 4 or 5, wherein the insert is substantially surrounded in the striking face's plane by said rest of the head.

7. An iron type golf club as claimed in either claim 2, 3 or 5 wherein the cavity has an area approximately the same as that area of the rear excluding the cavity.

8. An iron type golf club as claimed in any one of claims 2 to 4 wherein the head is perimeter weighted substantially completely around its' perimeter at both its rear and front.

9. An iron type golf club as claimed in any preceding claim wherein the insert at the striking face of the head is positioned at the sweet spot of the head.

10. An iron type golf club as claimed in any preceding claim wherein the insert at the striking face of the head is made of non-metallic material.

11. An iron type golf club as claimed in any one of claims 1–5 or 6–9 wherein the insert at the striking face is made partly from metallic material.

12. An iron type golf club as claimed in any preceding claim wherein the head has a front, and the insert at the striking face of the head is securely fixed within a cavity provided in the front of the head.

13. An iron type golf club as claimed in any preceding claim wherein the insert at the striking face of the head is positioned on the horizontal axis containing the center of mass of the head.

14. An iron type golf club as claimed in any preceding claim wherein the mass of the head is substantially located around the perimeter of the sweet spot.

15. An iron type golf club as claimed in any preceding claim wherein a part of said rest of the head is positioned behind the insert at the striking face of the head.

16. An iron type golf club as claimed in any preceding claim wherein the head has a rear or back, and wherein an insert is provided in the cavity in the rear or back of the head.

17. An iron type golf club as claimed in claim 16 wherein the insert in the cavity in the rear or back of the head is connected to the insert at the striking face of the head.

18. An iron type golf club as claimed in any one of claims 1 to 15 wherein the head has a rear or back, wherein an insert is provided in the cavity in the rear or back of the head, and wherein the insert in the cavity in the rear or back of the head is connected to the insert at the striking face of the head through a part of said rest of the head positioned behind the insert at the striking face of the head.

19. An iron type golf club as claimed in any preceding claim wherein the head is injection moulded.

20. An iron type golf club as claimed in any preceding claim wherein said rest of the head has a varied cross-sectional thickness along its length.

21. An iron type golf club as claimed claim 20 wherein the perimeter of said rest of the head has a cross-sectional thickness greater than the center portion of said rest of the head.

22. An iron type golf club as claimed in any preceding claim wherein the insert at the striking face of the head is surrounded on all four sides in the striking face's plane by said rest of the head.

23. An iron-type golf club as claimed in any proceeding claim wherein at least part of the rest of the head is positioned to the rear of the front insert in order to provide a backing for the front insert.

* * * * *